United States Patent [19]

Pezzoli

[11] Patent Number: 4,736,778

[45] Date of Patent: Apr. 12, 1988

[54] WEFT CARRYING GRIPPER FOR A WEAVING LOOM

[75] Inventor: Nello Pezzoli, Leffe, Italy

[73] Assignee: Vamatex S.p.A., Villa Di Serio, Italy

[21] Appl. No.: 919,771

[22] Filed: Oct. 15, 1986

Related U.S. Application Data

[63] Continuation-in-part of Ser. No. 844,259, Mar. 24, 1986, Pat. No. 4,632,152, which is a continuation of Ser. No. 658,802, Oct. 9, 1984, abandoned.

[30] Foreign Application Priority Data

Oct. 7, 1983 [IT] Italy ..... 23196 A/83

[51] Int. Cl.[4] ..... D03D 47/22

[52] U.S. Cl. ..... 139/448

[58] Field of Search ..... 139/448, 449

[56] References Cited

U.S. PATENT DOCUMENTS

| | | | |
|---|---|---|---|
| 2,960,118 | 11/1960 | Ancet et al. | 139/448 |
| 4,129,155 | 12/1978 | Merisio | 139/448 |
| 4,505,305 | 3/1985 | Pezzoli | 139/448 |

FOREIGN PATENT DOCUMENTS

| | | | |
|---|---|---|---|
| 2142581 | 2/1973 | France | 139/448 |
| 131386 | 6/1978 | German Democratic Rep. | 139/448 |

*Primary Examiner*—Henry S. Jaudon
*Attorney, Agent, or Firm*—Young & Thompson

[57] ABSTRACT

A weft carrying gripper for a weaving loom comprises a gripper body and a weft yarn holding member carried by the gripper body and oscillable relative to the gripper body about an axis parallel to the direction of movement of the gripper alternately to grip and release a weft yarn between a head on the holding member and the body. The head includes a resilient metal lamina secured to the head only at its rear end and extending forwardly to a free forward end. The lamina between its rear end and its free forward end has a straight portion that terminates forwardly in the free end. The free end curves from the forward end of the straight portion away from the body. The head has a recess behind the straight portion and the free end such that, when the holding member has oscillated toward the body, the straight portion lies flat against the body and the straight portion and the free end are free to flex away from the body under the pressure of a weft yarn inserted between the lamina and the body. When the holding member has been oscillated away from the body, the lamina is spaced from the body but inclined forwardly toward the body, whereby the first portion of the lamina to touch the body upon oscillation of the holding member toward the body is at the juncture of the straight portion and the free end of the lamina.

1 Claim, 1 Drawing Sheet

WEFT CARRYING GRIPPER FOR A WEAVING LOOM

RELATION TO OTHER APPLICATIONS

This application is a continuation-in-part of my copending application Ser. No. 844,259, filed Mar. 24, 1986, and now U.S. Pat. No. 4,632,152, which is a continuation of Ser. No. 658,802, filed Oct. 9, 1984 and now abandoned.

FIELD OF THE INVENTION

The present invention relates to weft carrying grippers for weaving looms, of the type disclosed in my U.S. Pat. No. 4,505,305 and the above-identified copending application, the disclosure of both of which is incorporated herein by reference.

BACKGROUND OF THE INVENTION

As is well known, in modern looms, a carrying gripper carries yarn into the sheds, where the yarn is picked up by a drawing gripper. The grippers reciprocate toward and away from each other at high speed and high frequency, and this complicates the gripping, holding and exchange operations between the grippers.

The problem is further complicated by modern production requirements, in which various yarns may be used which are difficult to work with because they are of irregular count. Moreover, it may be desired to provide for the insertion of two yarns at a time.

SUMMARY OF THE INVENTION

The present invention provides a solution to the problems enumerated above, in the form of a weft carrying gripper which has a desirable flexibility in the yarn gripping area and so allows, on the one hand, yarn insertion under even the most unfavorable conditions such as variable voltage of the current feed, count irregularities, and the like, thereby providing the proper gripping of the yarn under all circumstances, as well as providing a device that is easy to clean in the contact and gripping areas.

To achieve this, the present invention provides a weft carrying gripper of the type referenced above, in which a weft holding member moves into and out of engagement with the gripper body by rotation about an axis extending longitudinally of the gripper, that is, parallel to the direction of reciprocation of the gripper, the point of engagement of the holding member with the gripper being eccentric to that axis, and the holding member having thereon a spring lamina which contacts the gripper body and is deflected by the gripper body into a position in which it is seated against the gripper body when the parts are at rest. In that seated position, however, the lamina, which is secured at its basal end, is extended at its distal end a substantial distance beyond any contact with the holding member and thereafter terminates at its distal end in an arcuate portion that curves away from the gripper body, the lamina on the side thereof opposite at least most of the portion of the gripper body contacted by the lamina being unsupported and hence free to flex further under the impetus of the yarn, not only at said distal end but also rearwardly up to adjacent said secured basal end, with the result that every portion of the lamina contacted by the yarn is unsupported on the side thereof opposite the yarn. The pressure applied by the lamina on the yarn is thus entirely due to the resilience of the lamina, and not to any backing action of the holding member against the lamina.

BRIEF DESCRIPTION OF THE DRAWINGS

These and other features and advantages of the present invention will become apparent from a consideration of the following description, taken in connection with the accompanying drawings, in which.

DESCRIPTION OF THE PREFERRED EMBODIMENTS

Figure 1:
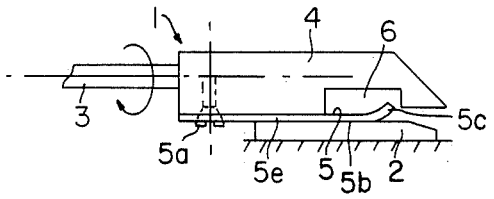
FIG. 1 is a diagrammatic view of a carrying gripper according to the present invention, in its operative position, that is, in which it is adapted to carry a yarn into the sheds for delivery to a drawing gripper.
Figure 2:
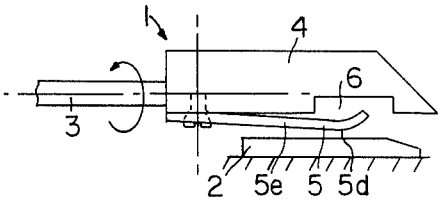
FIG. 2 is a view similar to FIG. 1, but showing the gripper in its inoperative or yarn-releasing position.

Referring now to the drawings in greater detail, and first to FIGS. 1 and 2 thereof, in which the invention is diagrammatically illustrated, there is shown a carrying gripper of the type according to my U.S. Pat. No. 4,505,305 mentioned above, wherein the weft yarn holding member 1 engages the gripper body 2 and is mounted on and rotatable about a shaft 3 between the positions of FIGS. 1 and 2. Shaft 3 extends lengthwise of the associated gripper body 2, which, as shown in the earlier patent, is considerably elongated principally to the left of FIGS. 1 and 2. As is also brought out in that patent, the oscillatory rotation of shaft 3 is caused by interacting cam members, one on the gripper body and another on the machinery in the path of the gripper body, so that the gripper moves between the FIG. 1 and FIG. 2 positions and back, once each reciprocation of the gripper.

On the underside of the head 4 which is a part of holding member 1 there is provided an elongated resiliently flexible metal lamina 5, preferably of spring steel, which is secured by a screw **5*a* at its rear and is unsecured forwardly of screw 5*a*. Forwardly of screw 5*a*, which is to say to the right in FIGS. 1 and 2, lamina 5 is backed up over a portion of its length by head 4 in the engaged or FIG. 1 position; but farther forwardly, there is a straight extent 5*b* of lamina 5, which as shown in FIG. 2 is straight in its undeformed condition, which is backed up only by a cavity 6 and hence is free to flex into and out of engagement with gripper body 2. This straight stretch 5*b* terminates forwardly in a free forward end 5*c* which is gradually curved away from gripper body 2, into cavity 6, but still is out of contact with any side wall of cavity 6 in any position of lamina 5. It will of course be understood that cavity 6 is of a size and shape sufficient to accommodate portions 5*b* and 5*c* of lamina 5 with clearance in all positions of lamina 5**.

FIG. 2 shows, as stated above, the parts in the disengaged position. Between the FIG. 1 and the FIG. 2 positions, shaft 3 has rotated so as to swing lamina 5 up and away from and out of contact with gripper body 2. For this purpose, lamina 5, which extends generally parallel to shaft 3, is offset a substantial distance from the axis of shaft 3 and below that axis. In FIGS. 1 and 2, accordingly, lamina 5 is substantially closer to the viewer than is the axis of shaft 3.

As will be further seen in FIG. 2, straight portion **5*b* and curved end 5*c* of lamina 5 meet at an initial curved portion 5*d*; and that portion 5*d*** is closest to gripper body 2 in the inoperative or released condition of FIG. 2 and hence is the first portion of lamina 5 to touch gripper body 2 when moving to the FIG. 1 position. After this initial contact, moving from FIG. 2 to FIG. 1, it will be appreciated that lamina 5 tends to flatten out against gripper body 2, thanks to the resilience of lamina 5. Of course lamina 5 is initially so shaped as to assume the FIG. 2 position when secured to head 4 by screw 5*a*.

Notice also, in FIGS. 1 and 2, that there is a further straight stretch 5*e* of lamina 5, between screw 5*a* and recess 6. This portion underlies head 4 between the secured rear end of lamina 5 and recess 6 and diverges from head 4 from that secured rear end to the recess. As also seen in those figures, straight stretches 5*e* and 5*b* are coplanar.

In operation, a weft yarn (not shown) will enter the gap between end 5*c* and gripper body 2, as the gripper moves to the right as seen in FIG. 1. With the parts in the FIG. 1 position, the yarn will become wedged between lamina 5 and body 2, the resilience of lamina 5 permitting the yarn to become wedged more or less deeply according to the tension in the yarn. The fact that not only end 5*c* but also straight stretch 5*b* is unsupported on its side opposite body 2, means that the resistance of the assembly of lamina 5 and body 2, to the penetration of the yarn, will increase progressively the deeper the yarn penetrates between lamina 5 and body 2, the arrangement of the parts obviously preventing penetration of the yarn rearwardly beyond straight stretch 5*b*, because lamina 5 rearwardly of straight stretch 5*b* is backed up by head 4.

Thus, in the forward direction, a substantial straight length 5*b* of lamina 5 will be provided, which is backed up only by cavity 6 and hence is free to flex away from gripper body 2. In addition, the distal end 5*c* performs a yarn guiding function, providing in effect a mouth that the yarn can conveniently and reliably enter prior to becoming wedged and gripped between lamina 5 and body 2 a substantial distance forwardly of the point at which head 4 backs up lamina 5.

Thus, the unique wedging action of the present invention could not be performed by end 5*c* alone, nor by straight stretch 5*b* alone, but rather is achieved by the combination of the two.

Figure 3:
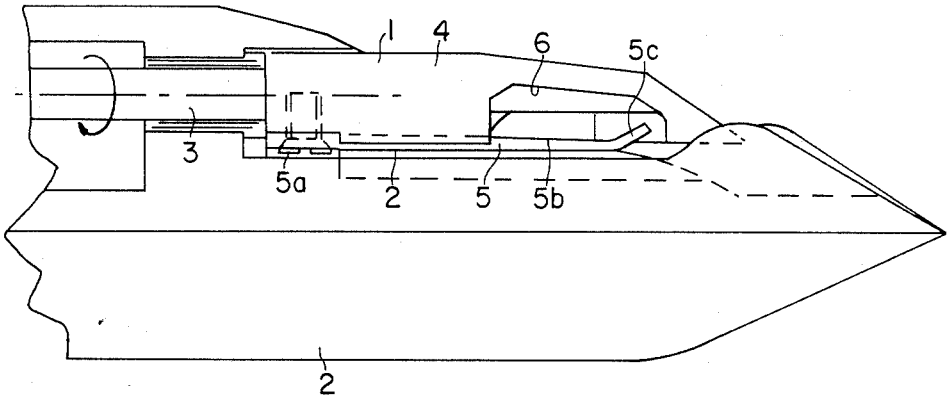
FIG. 3 is a view similar to FIG. 1, but showing the construction of the device in greater detail.

Turning now to FIG. 3, an actual construction according to the present invention is illustrated, in which the parts corresponding to FIGS. 1 and 2 have the same reference numerals and in which it will be seen that lamina 5 contacts gripper body 2 which is carried by gripper head 2'.

It will be understood from the foregoing, that the weft gripper of the present invention has a construction in which the lamina has a flexibility substantially greater than that of known grippers of weaving looms, so that a weft carrying gripper according to the present invention provides a smooth but firm and reliable engagement of any type of yarn and under any possible operating conditions.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a weft carrying gripper for a weaving loom comprising a gripper head and a weft yarn holding member oscillable relative to the gripper head about an axis parallel to the direction of movement of the gripper alternately to grip and release a weft yarn between said holding member and a gripper body carried by said gripper head; the improvement in which said holding member includes a resilient metal lamina secured to said holding member only at the rear end of said lamina and extending forwardly to a free forward end of said lamina, said lamina between said rear end and said free forward end having a straight portion that terminates forwardly in said free end and said free end being arcuate so as to curve away from said gripper body, said holding member having a recess and said straight portion and said free end being disposed between said recess and said gripper body such that, when said holding member has oscillated toward said gripper body, said straight portion lies flat against said gripper body and said straight portion and said free end are free to flex away from said gripper body and into said recess under pressure between said lamina and said contact area of said gripper body, said secured rear end of said lamina being spaced a substantial distance to the rear of said recess whereby a portion of substantial length of said lamina underlies said holding member between said secured rear end of said lamina and said recess, said underlying portion of said lamina diverging from said holding member from said secured rear end toward said recess, whereby when said holding member has been oscillated away from said gripper body, said lamina is spaced from said gripper body but inclined forwardly toward said gripper body, whereby the first portion of said lamina to touch said said gripper body upon oscillation of said holding member toward said gripper body is at the juncture of said straight portion and said arcuate free end of said lamina.

* * * * *